US006936577B2

(12) United States Patent
Dontula et al.

(10) Patent No.: US 6,936,577 B2
(45) Date of Patent: Aug. 30, 2005

(54) DETERGENT COMPOSITIONS

(75) Inventors: Prasanna Rao Dontula, AT Vlaardingen (NL); Alyn James Parry, Merseyside (GB); Catherine Maria Powell, Merseyside (GB); Karen Robinson, Merseyside (GB); Wiebe Schokker, AT Vlaardingen (NL); Gilbert Martin Verschelling, AT Vlaardingen (NL); Pieter Broer van der Weg, AT Vlaardingen (NL)

(73) Assignee: Unilever Home Products and Care USA, division of Conopco, Inc., Greenwich, CT (US)

( * ) Notice: Subject to any disclaimer, the term of this patent is extended or adjusted under 35 U.S.C. 154(b) by 245 days.

(21) Appl. No.: 10/273,330

(22) Filed: Oct. 17, 2002

(65) Prior Publication Data

US 2003/0130157 A1 Jul. 10, 2003

(30) Foreign Application Priority Data

Oct. 19, 2001 (GB) ..... 0125212

(51) Int. Cl.[7] ..... C11D 17/06; C11D 11/00; C11D 3/10

(52) U.S. Cl. ..... 510/276; 510/438; 510/444; 510/477; 510/509

(58) Field of Search ..... 510/276, 438, 510/444, 477, 509

(56) References Cited

U.S. PATENT DOCUMENTS

| | | | | | |
|---|---|---|---|---|---|
| 4,210,550 | A | * | 7/1980 | Cornelissens | 510/349 |
| 5,338,476 | A | * | 8/1994 | Pancheri et al. | 510/352 |
| 5,723,428 | A | | 3/1998 | Boskamp et al. | 510/481 |
| 5,990,068 | A | * | 11/1999 | Brouwer et al. | 510/276 |
| 6,069,124 | A | | 5/2000 | Appel et al. | 510/438 |
| 6,080,711 | A | * | 6/2000 | Brouwer et al. | 510/324 |
| 6,093,218 | A | * | 7/2000 | Hall et al. | 8/137 |
| 6,096,703 | A | * | 8/2000 | Hall | 510/441 |
| 6,177,397 | B1 | * | 1/2001 | Staley | 510/444 |

FOREIGN PATENT DOCUMENTS

| | | |
|---|---|---|
| DE | 100 62 007 | 7/2002 |
| EP | 229 671 | 7/1987 |
| EP | 270 240 | 6/1988 |
| EP | 456 315 | 11/1992 |
| EP | 534 525 | 3/1993 |
| EP | 560 395 | 9/1993 |
| EP | 578 871 | 1/1994 |
| EP | 581 857 | 2/1994 |
| GB | 2 315 761 | 2/1998 |
| GB | 2 323 386 | 9/1998 |
| GB | 2 355 722 | 5/2001 |
| WO | 92/18596 | 10/1992 |
| WO | 97/32954 | 9/1997 |
| WO | 98/04662 | 2/1998 |
| WO | 99/36494 | 7/1999 |
| WO | 00/31233 | 6/2000 |
| WO | 00/34422 | 6/2000 |
| WO | 00/37605 | 6/2000 |

OTHER PUBLICATIONS

Derwent Abstract of JP 11 32339—published Nov. 26, 1999.
Derwent Abstract of JP 62 054799—published Mar. 10, 1987.
Co–pending application: Applicant. Dontula et al., U.S. Appl. No. 10/273,132: filed: Oct. 17, 2002.
Co–pending applicatin: Applicant: Dontula et al., U.S. Appl. No. 10/273,331; filed: Oct. 17, 2002.
Derwent Abstract of DE 100 62 007 published Jul. 4, 2002.
Co–pending Application: Applicant: Del Nunzio et al.; U.S. Appl. No. 10/664,369; filed Sep. 17, 2003.

* cited by examiner

*Primary Examiner*—Lorna M. Douyon

(57) ABSTRACT

A particulate laundry detergent composition which comprises a detergent base powder comprising surfactant and builder and, as separate particulate components:

(a) an alkali metal carbonate salt selected from carbonate, bicarbonate, sesquicarbonate and combinations thereof; and (b) a water-soluble organic acid which, when reacted with (a) in the presence of water, generates carbon dioxide gas;

wherein the alkali metal carbonate salt, when taken separately, has a 90% dissolution time of less than 15 seconds, preferably less than 10 seconds, more preferably less than 7 seconds; and the water-soluble organic acid has a $d_{50}$ particle size which is in the range of from 150 to 1500 microns. The alkali metal carbonate salt preferably has an average bulk density of at most 1000 g/l, preferably at most 800 g/l, more preferably at most 600 g/l. The alkali metal carbonate salt preferably has a $d_{50}$ particle size of at most 250 microns, preferably from 1 to 200 microns, more preferably from 10 to 150 microns. The alkali metal carbonate salt is preferably sodium and/or potassium carbonate.

14 Claims, No Drawings

DETERGENT COMPOSITIONS

TECHNICAL FIELD

The present invention relates to particulate detergent compositions with improved dispensing properties.

BACKGROUND OF THE INVENTION

The problem of providing improved dispensing, dispersing and dissolving laundry detergent powders is well-known and has been addressed many times in the past. It is undesirable, for example, to have a slow dispensing powder which forms a residue in the drawer of many automatic washing machines. One method of improving the dispensing properties of particulate detergent powders is to include effervescent ingredients.

EP 456 315 (P&G) discloses detergent compositions comprising citric acid and particulate carbonate but no details of the specific grade of carbonate are disclosed.

EP 581 857 (Procter & Gamble) discloses a detergent composition which comprises post dosed sodium carbonate and citric acid where the weight ratio of carbonate to citric acid is from 2:1 to 15:1.

EP 534 525 (Unilever) discloses medium to high bulk density detergent powders comprising carbonate and citric acid whereby more than 80 wt % of the citric acid has a particle size which is in the range of from 350 to 1500 $\mu$m. The coarse size of citric acid provides improved moisture stability.

In spite of the moisture stability problem, recent developments have suggested using fine particulate acid source:

WO 98 04662 (Procter & Gamble) discloses a detergent composition comprising effervescent components wherein about 80 wt % of the acid source has a particle size in the range of from 150 $\mu$m to about 710 microns with at least 37 wt % of the acid source having a particle size of 350 $\mu$m or less.

WO 00 34422 (Procter & Gamble) discloses an effervescent composition comprising an acid source and a carbon dioxide source wherein at least 75% of the acid source has a particle size of from 0.1 to 150 microns; preferably the carbon dioxide source has a volume median particle size of from 5 to 375 microns whereby at least 60% has a particle size of from 1 to 425 microns.

SUMMARY OF INVENTION

Surprisingly the present inventors have found that the dispensing times of laundry detergent powders can be significantly improved by adding a water-soluble solid organic acid and a carbonate salt as separate components, when the carbonate salt is fast-dissolving and the organic acid has a relatively large particle size. Thus, the requirements of processing simplicity, moisture stability, and rapid effervescence leading to improved dispensing of the detergent are achieved.

STATEMENT OF INVENTION

In a first aspect, the present invention provides a particulate laundry detergent composition which comprises a detergent base powder comprising surfactant and builder and, as separate particulate components:

(a) an alkali metal carbonate salt selected from carbonate, bicarbonate, sesquicarbonate and combinations thereof; and (b) a water-soluble solid organic acid which, when reacted with (a) in the presence of water, generates carbon dioxide gas;

wherein the alkali metal carbonate salt, when taken separately, has a 90% dissolution time of less than 15 seconds; and the water-soluble organic acid has a dparticle size which is in the range of from 150 to 1500 microns.

In a second aspect, the present invention provides a process for making a laundry detergent composition as defined above, which comprises the steps of:

(i) preparing a detergent base powder, comprising surfactant and builder; followed by (ii) dry-mixing with the base powder (a) an alkali metal carbonate salt selected from carbonate, bicarbonate, sesquicarbonate and combinations thereof; and (b) a water-soluble organic acid which, when reacted with (a) in the presence of water, generates carbon dioxide gas;

wherein the alkali metal carbonate salt, when taken separately, has a 90% dissolution time of less than 15 seconds; and the water-soluble organic acid has a dparticle size which is in the range of from 150 to 1500 microns.

In a third aspect, the present invention provides the use of the above-defined composition to improve dispensing times of particulate detergent compositions.

DETAILED DESCRIPTION OF THE INVENTION d50 Particle Size

The d particle size of a particulate material is the particle size diameter at which 50 wt % of the particles are larger in diameter and 50 wt % are smaller in diameter.

Particle size may be measured by any suitable method. For the purposes of the present invention particle sizes and distributions were measured using a Helos laser spectrograph.

'90% Dissolution Time' Test Method 500 ml of demineralised water at 10° C. is put in a 1 litre wide model beaker. A magnetic stirrer bar 6.4 cm is used and the stirring rate is set in such a way that a vortex 40 mm in diameter is reached. A powder sample of 2.5 grams is added and the conductivity of the generated solution is measured as a function of time using a conductivity probe (a Schott Konduktometer CG 855 with a Unicam 9550 conductivity cell).

The conductivity profile can be followed using a plotter, but in this case was also recorded using a Grant Series 1000 datalogger, which logged the data every 0.5 second. After the full conductivity was reached (typically 0.5–2 minutes), the experiment was stopped. The '90% dissolution time' is then calculated as the time at which the conductivity reaches 90% of the final value.

The Alkali Metal Carbonate Salt

The alkali metal salt is present as a separate particulate component from both the organic acid and the detergent base powder.

The alkali metal salt must be capable of releasing carbon dioxide gas when reacted with an acid source in the presence of water. For these purposes the alkali metal salt is advantageously selected from carbonate, bicarbonate and/or sesquicarbonate. For the best combination of cost and effectiveness, carbonate is preferred.

The carbonate salt should be fast-dissolving and have a 90% dissolution time of less than 15 seconds in water at 10° C. It is preferred that the carbonate salt has a 90% dissolution time of less than 10 seconds, preferably less than 7 seconds. '90% dissolution time' is a measure of the time taken for the conductivity of an aqueous solution of the material under test to reach 90% of its final value, as described in detail above.

Without wishing to be bound by theory it is believed that if the carbonate is fast-dissolving it generates carbon dioxide at an increased rate which therefore increases the dispensing improvement provided by the effervescent action.

In order for the alkali metal carbonate salt to be effective it is preferred that the composition comprises at least 1 wt % of alkali metal carbonate salt, preferably from 2 to 10 wt %.

It is preferred that the alkali metal carbonate salt has an average bulk density of at most 1000 g/l, preferably at most 800 g/l, more preferably at most 600 g/l.

In a preferred embodiment the alkali metal carbonate salt has a dparticle size of at most 250 microns, preferably from 1 to 200 microns, more preferably from 10 to 150 microns.

It is preferred that the alkali metal salt comprises sodium and/or potassium carbonate.

Commercially available 'light' sodium carbonate has a bulk density of about 550 g/l and a d particle size of about 200 microns. Commercially available 'dense' sodium carbonate has a bulk density of about 1050 g/l and a d particle size of about 400 microns.

The Water-Soluble Organic Acid

The water-soluble organic acid is present as a separate particulate component.

The particle size of the water-soluble organic acid is important. If the particle size is too small then the particles will be vulnerable to reaction with moisture and may be unstable. Therefore it is preferred that the water-soluble organic acid has a dparticle size which is in the range of from 150 to 1500 microns, preferably in the range of from 250 to 1000 microns, more preferably in the range of from 350 to 750 microns.

The composition should contain an effective amount of the water-soluble organic acid, hence preferably the composition comprises at least 0.5 wt % of the water-soluble organic acid, preferably from 1 to 10 wt %, more preferably 2 to 5 wt %.

Highly preferred organic acids are citric acid, succinic acid and glutaric acid.

Base Powder

The detergent compositions of the present invention preferably comprise a base powder obtained by granulation. The present invention may also comprise a spray-dried base powder. However, if this is the case then the detergent composition as a whole preferably comprises no more than 70 wt % spray dried base powder.

Compositions of the present invention preferably comprise at least 10 wt % granular base powder, and preferably comprise from 20 to 90 wt % granular base powder.

Any granular base powder which may be present will comprise surfactant and builder and preferably has a bulk density of at least 0.5 kg/l, more preferably at least 0.6 kg/l.

Granular base powders may be prepared by mixing and granulating processes, for example, using a high-speed mixer/granulator, and/or other non-spray drying processes such as fluid bed granulation.

Detergent Ingredients

Detergent compositions according to the invention contain, as well as the alkali metal carbonate salt and the water-soluble organic acid, conventional detergent ingredients, notably detergent-active materials (surfactants), and preferably also detergency builders.

Laundry detergent compositions in accordance with the invention may suitably comprise from 5 to 60 wt % of detergent-active surfactant, from 10 to 80 wt % of detergency builder, and optionally other detergent ingredients to 100 wt %.

The detergent compositions will contain, as essential ingredients, one or more detergent active compounds (surfactants) which may be chosen from soap and non-soap anionic, cationic, nonionic, amphoteric and zwitterionic detergent active compounds, and mixtures thereof. Many suitable detergent active compounds are available and are fully described in the literature, for example, in "Surface-Active Agents and Detergents", Volumes I and II, by Schwartz, Perry and Berch.

The preferred detergent active compounds that can be used are soaps and synthetic non-soap anionic and nonionic compounds. Non-soap anionic surfactants are especially preferred.

Non-soap anionic surfactants are well-known to those skilled in the art. Examples include alkylbenzene sulphonates, particularly linear alkylbenzene sulphonates having an alkyl chain length of C—C; primary and secondary alkylsulphates, particularly C—C primary alkyl sulphates; alkyl ether sulphates; olefin sulphonates; alkyl xylene sulphonates; dialkyl sulphosuccinates; and fatty acid ester sulphonates. Sodium salts are generally preferred. A preferred anionic surfactant is linear alkylbenzene sulphonate.

Nonionic surfactants may optionally be present. These include the primary and secondary alcohol ethoxylates, especially the C—C aliphatic alcohols ethoxylated with an average of from 1 to 20 moles of ethylene oxide per mole of alcohol, and more especially the C—C primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants may optionally be present. These include quaternary ammonium salts of the general formula RRRRN X wherein the R groups are long or short hydrocarbyl chains, typically alkyl, hydroxyalkyl or ethoxylated alkyl groups, and X is a solubilising anion (for example, compounds in which R is a CC alkyl group, preferably a C—C or C—C alkyl group, R is a methyl group, and R and R, which may be the same or different, are methyl or hydroxyethyl groups); and cationic esters (for example, choline esters).

In an especially preferred cationic surfactant of the general formula RRRRN X, R represents a C—C or C—C alkyl group, R and R represent methyl groups, R presents a hydroxyethyl group, and X represents a halide or methosulphate ion.

Optionally, amphoteric surfactants, for example, amine oxides, and zwitterionic surfactants, for example, betaines, may also be present.

Preferably, the quantity of anionic surfactant is in the range of from 3 to 50% by weight of the total composition. More preferably, the quantity of anionic surfactant is in the range of from 5 to 35 wt %, most preferably from 10 to 30 wt %.

Nonionic surfactant, if present, in addition to any which may be present as emulsifier in the speckles, is preferably used in an amount within the range of from 1 to 20 wt % in addition to that which may be present in the structured emulsion.

The total amount of surfactant present is preferably within the range of from 5 to 60 wt %.

The compositions may suitably contain from 10 to 80 wt %, preferably from 15 to 70 wt %, of detergency builder. Preferably, the quantity of builder is in the range of from 15 to 50 wt %.

The detergent compositions may contain as builder a crystalline aluminosilicate, preferably an alkali metal aluminosilicate, more preferably a sodium aluminosilicate (zeolite).

The zeolite used as a builder may be the commercially available zeolite A (zeolite 4A) now widely used in laundry detergent powders. Alternatively, the zeolite may be maximum aluminium zeolite P (zeolite MAP) as described and claimed in EP 384 070B (Unilever), and commercially available as Doucil (Trade Mark) A24 from Crosfield Chemicals Ltd, UK.

Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20.

Especially preferred is zeolite MAP having a silicon to aluminium ratio not exceeding 1.07, more preferably about 1.00. The particle size of the zeolite is not critical. Zeolite A or zeolite MAP of any suitable particle size may be used.

Also preferred according to the present invention are phosphate builders, especially sodium tripolyphosphate. This may be used in combination with sodium orthophosphate, and/or sodium pyrophosphate.

Other inorganic builders that may be present additionally or alternatively include sodium carbonate, layered silicate, amorphous aluminosilicates.

Most preferably, the builder is selected from sodium tripolyphosphate, zeolite, sodium carbonate, and combinations thereof.

Organic builders may optionally be present. These include polycarboxylate polymers such as polyacrylates and acrylic/maleic copolymers; polyaspartates; monomeric polycarboxylates such as citrates, gluconates, oxydisuccinates, glycerol mono-di- and trisuccinates, carboxymethyloxysuccinates, carboxymethyloxymalonates, dipicolinates, hydroxyethyl iminodiacetates, alkyl- and alkenylmalonates and succinates; and sulphonated fatty acid salts.

Organic builders may be used in minor amounts as supplements to inorganic builders such as phosphates and zeolites. Especially preferred supplementary organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form. Detergent compositions according to the invention may also suitably contain a bleach system, although non-bleaching formulations are also within the scope of the invention.

The bleach system is preferably based on peroxy bleach compounds, for example, inorganic persalts or organic peroxyacids, capable of yielding hydrogen peroxide in aqueous solution. Suitable peroxy bleach compounds include organic peroxides such as urea peroxide, and inorganic persalts such as the alkali metal perborates, percarbonates, perphosphates, persilicates and persulphates.

Preferred inorganic persalts are sodium perborate monohydrate and tetrahydrate, and sodium percarbonate. The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'—tetracetyl ethylenediamine (TAED).

A bleach stabiliser (heavy metal sequestrant) may also be present. Suitable bleach stabilisers include ethylenediamine tetraacetate (EDTA) and the polyphosphonates such as Dequest (Trade Mark), EDTMP.

The detergent compositions may also contain one or more enzymes. Suitable enzymes include the proteases, amylases, cellulases, oxidases, peroxidases and lipases usable for incorporation in detergent compositions.

Preferred proteolytic enzymes (proteases) are catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available. Proteases of both high and low isoelectric point are suitable.

Other enzymes that may suitably be present include lipases, amylases, and cellulases including high-activity cellulases such as Carezyme (Trade Mark) ex Novo.

In particulate detergent compositions, detergency enzymes are commonly employed in granular form in amounts of from about 0.1 to about 3.0 wt %. However, any suitable physical form of enzyme may be used in any effective amount.

Antiredeposition agents, for example, cellulose esters and ethers, for example sodium carboxymethyl cellulose, may also be present.

The compositions may also contain soil release polymers, for example sulphonated and unsulphonated PET/POET polymers, both end-capped and non-end-capped, and polyethylene glycol/polyvinyl alcohol graft copolymers such as Sokolan (Trade Mark) HP22.

Especially preferred soil release polymers are the sulphonated non-end-capped polyesters described and claimed in WO 95 32997A (Rhodia Chimie).

The detergent compositions may also include one or more inorganic salts other than builder salts. These may include, for example, sodium bicarbonate, sodium silicate, sodium sulphate, magnesium sulphate, calcium sulphate, calcium chloride and sodium chloride. Preferred inorganic salts are sodium sulphate, sodium chloride, and combinations thereof.

The detergent compositions may also contain other inorganic materials, for example, calcite, silica, amorphous aluminosilicate, or clays.

Other ingredients that may be present include solvents, hydrotropes, fluorescers, dyes, photobleaches, foam boosters or foam controllers (antifoams) as appropriate, fabric conditioning compounds, and perfumes.

Preparation of the Detergent Composition

Powders of low to moderate bulk density may be prepared by spray-drying a slurry, and optionally postdosing (dry-mixing) further ingredients. "Concentrated" or "compact" powders may be prepared by mixing and granulating processes, for example, using a high-speed mixer/granulator, or other non-tower processes.

The detergent composition of the invention may alternatively be in tablet form. Tablets may be prepared by compacting powders, especially "concentrated" or "compact" powders, prepared as described above.

EXAMPLES

The invention will now be illustrated in further detail by means of the following Examples, in which parts and percentages are by weight unless otherwise stated.

Dissolution Rates and Particle Sizes of Ingredients

Table 1 shows the 90% dissolution times (T90) at 10° C. (measured as described above) and the d particle sizes (measured using a Helos laser spectrograph) of some alkali metal carbonate salts and solid organic acids.

TABLE 1

| Material | Bulk Density (g/l) | $d_{50}$ Particle size (microns) | Dissolution time, T90 (sec) |
|---|---|---|---|
| 'dense' Sodium carbonate (commercial) | 1050 | 431 | 34 |
| 'dense' Sodium carbonate (sieve fractions) | 1050 | 202 | 15 |
| | | 365 | 29 |
| | | 664 | 45 |
| 'light' Sodium carbonate | 565 | 138 | 6 |
| Potassium carbonate | 905 | 137 | 4 |
| Sodium percarbonate | 975 | 624 | 80 |
| Citric acid (grade 1) | 900 | 429 | — |
| Citric acid (grade 2) | — | 582 | — |
| Glutaric acid | — | 674 | — |
| Succinic acid | — | 350 | — |

Dispensing Test Protocol

For the purposes of the present invention, dispensing is assessed by means of a standard procedure using a test rig based on the main wash compartment of the dispenser drawer of the Philips (Trade Mark) AFG washing machine. This drawer design provides an especially stringent test of dispensing characteristics especially when used under conditions of low temperature, low water pressure and low rate of water flow.

The drawer is of generally cuboidal shape and consists of three larger compartments, plus a small front compartment and a separate compartment for fabric conditioner. Only the middle (main wash) compartment is used in the test, the other compartments play no part in the test.

In the plate above the drawer an area has been cut away without affecting the spray holes, to allow visual inspection of the dispensing process.

In the test, a 100 g dose of powder is placed in a heap at the front end of the main compartment of the drawer, and subjected to a controlled water fill rate of 3 or 5 litres/minute at 10° C. The water enters through 2 mm diameter holes in a plate above the drawer: some water enters the front compartment and therefore does not reach the powder. Powder and water in principle leave the drawer at the rear end which is open.

The dispensing of the powder is followed visually and the time at which all the powder is dispensed is recorded. After the maximum dispensing time (in most cases set at 1 minute) the flow of water is ceased, and any powder remaining is then collected and dried at 95° C. to constant weight. The dry weight of powder recovered from the dispenser drawer, in grams, represents the weight percentage of powder not dispensed into the machine (the residue). Every result is the average of two duplicate measurements. Total dispensing is followed up to 60 seconds or 120 seconds depending on whether any residue is left after 60 seconds.

Examples 1 to 3 and Comparative Examples A to E

A detergent base powder was prepared to the composition shown in Table 2, by a non-tower granulation process. Additional ingredients as shown in Table 3 were admixed and dispensing times measured as described above.

TABLE 2

| Ingredient | Wt % |
|---|---|
| Sodium linear alkyl benzene sulphonate | 15.4 |
| Alcohol-ethoxylate 7EO | 12.0 |
| Tallow soap | 1.7 |
| Zeolite MAP (100%) | 39.5 |
| Sodium Carbonate | 12.9 |
| Sodium carboxy methylcellulose (68% active) | 0.8 |
| Sodium sulphate | 9.7 |
| Moisture + salts | 8.0 |
| Bulk Density (kg/l) | 0.78 ± 0.05 |

The slow dissolving 'dense' sodium carbonate used was the commercial material shown in Table 1, having a d particle size of 431 microns and a 90% dissolution time (T90) of 34 seconds. The fast dissolving 'light' sodium carbonate used (as shown in Table 1) had a dparticle size of 138 microns and a 90% dissolution time of 6 seconds. The citric acid used was grade 1 as shown in Table 1, having a d particle size of 429 microns.

The dispensing results are given in Table 3, which shows the dissolution times of compositions both inside the scope of the present invention (Examples 1 to 3) and outside the scope of the present invention (Comparative Examples A to E).

TABLE 3

| Component | A | B | C | 1 | D | 2 | E | 3 |
|---|---|---|---|---|---|---|---|---|
| Base powder | 94.5 | 94.5 | 94.5 | 94.5 | 93.5 | 93.5 | 92 | 92 |
| Sodium sulphate | 5.5 | 2.5 | — | — | — | — | — | — |
| 'dense' Sodium carbonate | — | 3 | 3 | — | 5 | — | 7 | — |
| 'light' Sodium Carbonate | — | — | — | 3 | — | 5 | — | 7 |
| Citric acid | — | — | 2.5 | 2.5 | 1.5 | 1.5 | 1 | 1 |
| Dispensing time at 5 1/min (sec) | >120 | >120 | 45.5 | 31 | 42.5 | 34 | 38 | 34.5 |
| Dispensing time at 3 1/min (sec) | >120 | >120 | 57 | 46.5 | 59 | 46.5 | 62.5 | 47.5 |

In all cases according to the invention, the dispensing time was considerably less than for the comparative formulation containing slow dissolving carbonate.

Example 4 and Comparative Examples F to I

The following examples show the effect of different sizes of dense carbonate (Comparative Examples F to I) and light sodium carbonate (Example 5) on the dispensing time of the base powder defined in Table 2.

As can be seen the powder within the invention has a greatly decreased dispensing time.

TABLE 4

| Ingredient | F | G | H | I | 4 |
|---|---|---|---|---|---|
| Base powder | 94.5 | 94.5 | 94.5 | 94.5 | 94.5 |
| 'dense' Sodium carbonate (d50 = 202 μm, T90 = 15 s) | 3 | — | — | — | — |
| 'dense' Sodium carbonate (d50 = 365 μm, T90 = 29 s) | — | 3 | — | — | — |
| 'dense' Sodium carbonate (d50 = 664 μm, T90 = 45 s) | — | — | 3 | — | — |
| 'dense' Sodium carbonate (d50 = 431 μm, T90 = 34 s) | — | — | — | 3 | — |
| 'light' Sodium carbonate (d50 = 138 μm, T90 = 6 s) | — | — | — | — | 3 |
| Citric acid (grade 1) | 2.5 | 2.5 | 2.5 | 2.5 | 2.5 |
| Dispensing time at 5 1/min [seconds] | 36.5 | 40.5 | 40 | 39.5 | 28 |
| Dispensing time at 3 1/min [seconds] | 60 | 64 | 71 | 61 | 48 |

Examples 5 and 6 and Comparative Example J

The following examples show the effect of glutaric acid and citric acid, when combined with 'light' sodium carbonate, on the dispensing time of the granular base powder as defined in Table 2.

TABLE 5

| Ingredient | J | 5 | 6 |
|---|---|---|---|
| Base powder | 94.5 | 94.5 | 94.5 |
| 'light' sodium carbonate (d50 = 138 μm, T90 = 5 s) | 5.5 | 3 | 3 |
| Glutaric acid (d50 = 674 μm) | — | 2.5 | — |
| Citric acid (grade 1) (d50 = 429 μm) | — | — | 2.5 |
| Dispensing time at 3 1/min (sec) | 120 | 49 | 46.5 |

Examples 7 to 9 and Comparative Example K

A similar experiment was carried using a different base powder defined in Table 6, also prepared by a non-tower granulation process.

TABLE 6

| Ingredient | Wt % |
|---|---|
| Sodium linear alkyl benzene sulphonate | 17.8 |
| Alcohol-ethoxylate 7EO | 14.3 |
| Tallow Soap | 2.4 |
| Zeolite A24 (anhydrous) | 40.2 |
| 'light' sodium carbonate | 13.7 |
| Sodium silicate | 3.4 |
| Moisture + salts | 8.1 |
| Bulk Density (kg/l) | 640 ± 50 |

The dispensing results obtained with this base powder were as follows:

TABLE 7

| Ingredient | K | 7 | 8 | 10 |
|---|---|---|---|---|
| Base powder | 94.5 | 94.5 | 94.5 | 94.5 |
| 'light' sodium carbonate (d50 = 138 μm, T90 = 5 s) | 5.5 | 3 | 3 | 3 |
| Succinic acid (d50 = 350 μm) | — | 2.5 | — | — |
| Citric acid (grade 1) (d50 = 429 μm) | — | — | 2.5 | — |
| Citric acid (grade 2) (d50 = 682 μm) | — | — | — | 2.5 |
| Dispensing time at 3 1/min (sec) | >100 | 35 | 21 | 13 |

Example 10 and Comparative Examples L and M

The following examples show the benefit of post-dosing fast dissolving potassium carbonate and coarse citric acid.

Base powder 1 had the same composition and bulk density as the base powder specified in Table 2, and was prepared by the same method.

Base powder 3 was prepared by spray-drying and had the following composition:

TABLE 8

| Ingredient | Wt % |
|---|---|
| Sodium linear alkyl benzene sulphonate | 9.2 |
| Alcohol-ethoxylate NI-7EO | 6.9 |
| Soap | 2.0 |
| Zeolite A24 (100%) | 24.0 |
| Acrylic/maleic copolymer | 3.0 |
| Sodium carbonate | 18.3 |
| Sodium silicate | 1.9 |
| Sodium sulphate | 27.0 |
| Minors, moisture + salts | 7.7 |
| Bulk Density (kg/l) | 0.40 ± 0.05 |

Fully formulated detergent powders were prepared using these base powders and are given in Table 9 together with their dispensing times.

TABLE 9

| Ingredient | L | 10 | M |
|---|---|---|---|
| Base powder 1 | 30.2 | 30.2 | 30.2 |
| Base powder 3 | 42.5 | 42.5 | 42.5 |
| Fluorescer granule | 0.81 | 0.81 | 0.81 |
| Antifoam granule | 1.25 | 1.25 | 1.25 |
| Dequest 2016D (sequestrant) | 0.41 | 0.41 | 0.41 |
| Dequest 2047 (sequestrant) | 0.73 | 0.73 | 0.73 |
| Carbonate/disilicate cogranule | 3.66 | 1.90 | 3.26 |
| TAED (83% active) | 2.64 | 2.64 | 2.64 |
| Sodium percarbonate | 15.2 | 15.2 | 15.2 |
| 'dense' carbonate (d50 = 431 μm, T90 = 34 s) | 1.24 | — | — |
| Potassium carbonate (d50 = 137 μm, T90 = 4 s) | — | 3.00 | 3.00 |
| Citric acid (grade 1) (d50 = 429 μm) | 1.36 | 1.36 | — |
| Dispensing time at 5 1/min | 32 | 19 | 31 |

We claim:

1. A particulate laundry detergent composition which comprises a detergent base powder comprising surfactant and builder and, as separate particulate components:

(a) an alkali metal carbonate salt selected from carbonate, bicarbonate, sesquicarbonate and combinations thereof; and (b) a water-soluble organic acid which, when reacted with (a) in the presence of water, generates carbon dioxide gas;

wherein the alkali metal carbonate salt, when taken separately, has a 90% dissolution time of less than 15 seconds; has an average bulk density of at most 1000 g/l and a $d_{50}$ particle sixe of at most 250 microns and the water-soluble organic acid has a $d_{50}$ particle size which is in the range of from 250 to 1500 microns.

2. A composition as claimed in claim 1, wherein the alkali metal carbonate salt has a 90% dissolution time of less than 10 seconds, preferably less than 7 seconds.

3. A composition as claimed in claim 1, wherein the composition comprises at least 1 wt % of the alkali metal carbonate salt, preferably from 2 to 10 wt %.

4. A composition as claimed in claim 1, wherein the alkali metal carbonate salt has an average bulk density of at most 800 g/l, preferably at most 600 g/l.

5. A composition as claimed in claim 1, wherein the alkali metal carbonate salt has a $d_{50}$ particle size of from 1 to 200 microns, preferably from 10 to 150 microns.

6. A composition as claimed in claim 1, wherein the alkali metal carbonate salt comprises sodium and/or potassium carbonate.

7. A composition as claimed in claim 1, wherein the composition comprises at least 0.5 wt % of the water-soluble solid organic acid, preferably from 1 to 10 wt %, more preferably 2 to 5 wt %.

8. A composition as claimed in claim 1, wherein the water-soluble solid organic acid has a $d_{50}$ particle size which is in the range of from 250 to 1000 microns, preferably in the range of from 350 to 750 microns.

9. A composition as claimed in claim 1, wherein the water-soluble organic acid is selected from citric acid, succinic acid and glutaric acid.

10. A composition as claimed in claim 1, which comprises a granular detergent base powder comprising surfactant and builder and having a bulk density of at least 0.5 kg/l.

11. A composition as claimed in claim 1, which comprises from 5 to 60 wt % surfactant.

12. A composition as claimed in claim 1, which comprises from 10 to 80 wt % builder.

13. A process for making a laundry detergent composition according to claim 1, which comprises the steps of:

(i) preparing a detergent base powder, comprising surfactant and builder; followed by (ii) dry-mixing with the base powder (a) an alkali metal carbonate salt selected from carbonate, bicarbonate, sesquicarbonate and combinations thereof; and (b) a water-soluble organic acid which, when reacted with (a) in the presence of water, generates carbon dioxide gas wherein the alkali metal carbonate salt, when taken separately, has a 90% dissolution time of less than 15 seconds; and the water-soluble organic acid has a $d_{50}$ particle size which is in the range of from 250 to 1500 microns.

14. A process as claimed in claim 13, wherein the base powder is prepared by a non-spray drying granulation process.

* * * * *